US010453386B2

(12) United States Patent
Jang

(10) Patent No.: US 10,453,386 B2
(45) Date of Patent: Oct. 22, 2019

(54) EMISSION CONTROL DRIVER AND DISPLAY DEVICE HAVING THE SAME

(71) Applicant: SAMSUNG DISPLAY CO., LTD., Yongin-si, Gyeonggi-do (KR)

(72) Inventor: Hwan-Soo Jang, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/603,997

(22) Filed: May 24, 2017

(65) Prior Publication Data

US 2017/0345366 A1 Nov. 30, 2017

(30) Foreign Application Priority Data

May 25, 2016 (KR) ..... 10-2016-0064342

(51) Int. Cl.
*G09G 3/3225* (2016.01)
*G09G 3/3266* (2016.01)
*G09G 3/36* (2006.01)

(52) U.S. Cl.
CPC ..... *G09G 3/3225* (2013.01); *G09G 3/3266* (2013.01); *G09G 3/3674* (2013.01); *G09G 2300/0861* (2013.01); *G09G 2310/0286* (2013.01); *G09G 2310/08* (2013.01)

(58) Field of Classification Search
CPC .. G09G 3/3225; G09G 3/3266; G09G 3/3674; G09G 2300/0861; G09G 2310/0286; G09G 2310/08
See application file for complete search history.

(56) References Cited

U.S. PATENT DOCUMENTS 7,920,109 B2 * 4/2011 Chung ..... G09G 3/3266 345/82
9,454,934 B2 * 9/2016 Woo ..... G09G 3/3266
9,881,689 B2 * 1/2018 Lee ..... G11C 19/28
2008/0158109 A1 * 7/2008 Chung ..... G09G 3/3233 345/76
2010/0141641 A1 * 6/2010 Furuta ..... G11C 19/184 345/213

(Continued)

FOREIGN PATENT DOCUMENTS

KR 10-2006-0097819 A 9/2006
KR 10-2014-0025149 A 3/2014

*Primary Examiner* — Amare Mengistu
*Assistant Examiner* — Crystal Mathews
(74) *Attorney, Agent, or Firm* — Kile Park Reed & Houtteman PLLC

(57) ABSTRACT

An emission control driver includes a plurality of stages. Each stage includes three circuit blocks and two output transistors. A first circuit block generates first and second control signals based on a first clock signal and a start signal or carry signal. A second circuit block controls the voltage level of the first control signal based on the first control signal and a second clock signal. A third circuit block generates a third control signal based on the second control signal and the second clock signal. The first output transistor outputs a first voltage as an emission control signal based on the first control signal. A second output transistor outputs a second voltage as the emission control signal based on the third control signal. The second circuit block maintains the voltage level of the first control signal while the first output transistor is turned off.

18 Claims, 8 Drawing Sheets

(56) References Cited

U.S. PATENT DOCUMENTS

| | | | | |
|---|---|---|---|---|
| 2011/0057864 | A1* | 3/2011 | Chung | G09G 3/3266 345/76 |
| 2012/0062608 | A1* | 3/2012 | Kim | G09G 3/3233 345/690 |
| 2012/0105423 | A1* | 5/2012 | Chung | G09G 3/3266 345/212 |
| 2014/0055444 | A1* | 2/2014 | Jang | G09G 3/3291 345/213 |
| 2014/0078029 | A1* | 3/2014 | Jang | G09G 3/32 345/82 |
| 2016/0379558 | A1* | 12/2016 | Jeon | G09G 3/3225 345/213 |
| 2017/0345366 | A1* | 11/2017 | Jang | G09G 3/3674 |

* cited by examiner

EMISSION CONTROL DRIVER AND DISPLAY DEVICE HAVING THE SAME

CROSS-REFERENCE TO RELATED APPLICATION

Korean Patent Application No. 10-2016-0064342, filed on May 25, 2016, and entitled, "Emission Control Driver and Display Device Having the Same," is incorporated by reference herein in its entirety.

BACKGROUND

1. Field

One or more embodiments described herein relate to an emission control driver and a display device including an emission control driver.

2. Description of the Related Art

A variety of flat panel displays have been developed. Examples include liquid crystal displays, field emission displays, plasma display panels, and organic light emitting displays (OLEDs). OLEDs are thin and have a relatively wide viewing angle, rapid response speed, and low power consumption. One type of OLED has a scan driver, data driver, emission control driver, and a timing controller. The emission control driver may control brightness of the display panel by controlling the width of the emission control signal.

SUMMARY

In accordance with one or more embodiments, an emission control driver includes a plurality of stages, each of the stages including: a first circuit block to generate a first control signal and a second control signal based on a first clock signal and a start signal or a carry signal; a second circuit block to control a voltage level of the first control signal based on the first control signal and a second clock signal; a third circuit block to generate a third control signal based on the second control signal and the second clock signal; a first output transistor to output a first voltage as an emission control signal based on the first control signal provided to a first output node; and a second output transistor to output a second voltage as the emission control signal based on the third control signal provided to a second output node, wherein the second circuit block is to maintain a voltage level of the first control signal while the first output transistor is turned off.

The first circuit block may include a first switching transistor to turn on or turn off based on the first clock signal, the first switching transistor coupled between a first node and a start signal providing line or a carry signal providing line; a second switching transistor to turn on or turn off based on a voltage of the first node, the second switching transistor coupled between a first clock signal providing line and a second node; and a third switching transistor to turn on or turn off based on the first clock signal, the third switching transistor coupled between a second voltage providing line and second node. The voltage of the first node may be provided to the second circuit block as the first control signal, and the voltage of the second node may be provided to the third circuit block as the second control signal.

The second circuit block may include a fourth switching transistor to turn on or turn off based on the first control signal, the fourth switching transistor coupled between a second clock signal providing line and a third node; and a first capacitor coupled between a first node and the third node. The second circuit block may include a fifth switching transistor coupled between the third node and a second voltage providing line. The fifth switching transistor may turn on or turn off based on the second control signal. The fifth switching transistor may turn on or turn off based on the third control signal.

The second circuit block may include a sixth switching transistor to turn on or turn off based on the second clock signal, the sixth switching transistor coupled between the first node and a fourth node; and a seventh switching transistor to turn on or turn off based on the second control signal, the seventh switching transistor coupled between the fourth node and a second voltage providing line.

The third circuit block may include a fifth switching transistor to turn on or turn off based on the second control signal, the fifth switching transistor coupled between a fifth node and a second clock signal providing line; a second capacitor coupled between a second node and a fifth node; a sixth switching transistor to turn on or turn off based on the first control signal, the sixth switching transistor coupled between a second voltage providing line the second output node; a seventh switching transistor to turn on or turn off based on the first control signal, the seventh switching transistor coupled between a second voltage providing line and the second output node; and a third capacitor coupled between the second voltage providing line and the second output node. The first clock signal and the second clock signal may have a same period.

In accordance with one or more other embodiments, a display device includes a display panel including a plurality of pixels; a scan driver to provide scan signals to the pixels; a data driver to provide data signals to the pixels; an emission control driver including a plurality of stages to provide emission control signals to the pixels; and a timing controller to generate control signals to control the scan driver, the data driver, and the emission control driver, wherein each of the stages includes: a first circuit block to generate a first control signal and a second control signal based on a first clock signal and a start signal or a carry signal; a second circuit block to control a voltage level of the first control signal based on the first control signal and a second clock signal; a third circuit block to generate a third control signal based on the second control signal and the second clock signal; a first output transistor to output a first voltage as an emission control signal based on the first control signal provided to a first output node; and a second output transistor to output a second voltage as the emission control signal based on the third control signal provided to a second output node, wherein the second circuit block is to maintain a voltage level of the first control signal while the first output transistor is turned off.

The first circuit block may include a first switching transistor to turn on or turn off based on the first clock signal, the first switching transistor coupled between a first node and a start signal providing line or a carry signal providing line; a second switching transistor to turn on or turn off based on a voltage of the first node, the second switching transistor coupled between a first clock providing line and a second node; and a third switching transistor to turn on or turn off based on the first clock signal, the third switching transistor coupled between the second voltage providing line and second node. The voltage of the first node may be provided to the second circuit block as a first control signal, and the voltage of the second node may be provided to the third circuit block as a second control signal.

The second circuit block may include a fourth switching transistor to turn on or turn off based on the first control signal, the fourth switching transistor coupled between a second clock signal providing line and a third node; and a first capacitor coupled between a first node and the third node. The second circuit block may include a fifth switching transistor coupled between the third node and a second voltage providing line. The fifth switching transistor may turn on or turn off based on the second control signal. The fifth switching transistor may turn on or turn off based on the third control signal.

The second circuit block may include a sixth switching transistor to turn on or turn off based on the second clock signal, the sixth switching transistor coupled between the first node and a fourth node; and a seventh switching transistor to turn on or turn off based on the second control signal, the seventh switching transistor coupled between the fourth node and a second voltage providing line.

The third circuit block may include a fifth switching transistor to turn on or turn off based on the second control signal, the fifth switching transistor coupled between a fifth node and a second clock signal providing line; a second capacitor coupled between a second node and a fifth node; a sixth switching transistor to turn on or turn off based on the first control signal, the sixth switching transistor coupled between a second voltage providing line the second output node; a seventh switching transistor to turn on or turn off based on the first control signal, the seventh switching transistor coupled between a second voltage providing line and the second output node; and a third capacitor coupled between the second voltage providing line and the second output node. The first clock signal and the second clock signal may have a same period.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
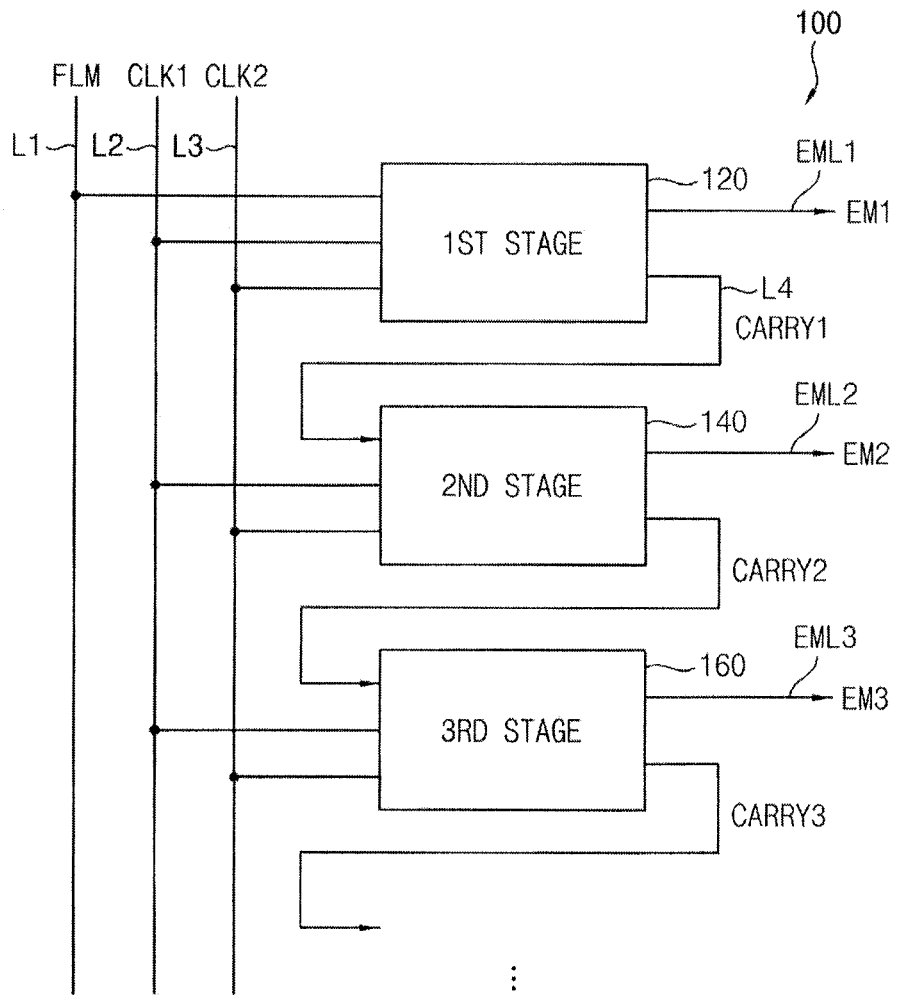
FIG. 1 illustrates an embodiment of an emission control driver.

Example embodiments will be described with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an emission control driver 100 which may include a plurality of stages 120, 140, 160. The stages 120, 140, 160 may be coupled and may sequentially output emission control signals EM1, EM2, EM3. The emission control signals EM1, EM2, EM3 may be sequentially provided to pixels of a display panel.

At least one of the stages 120, 140, 160 may receive a start signal FLM through a start signal providing line L1, e.g., stage 120. Each of the stages 120, 140, 160 may receive a first clock signal CLK1 through a first clock signal providing line L2 and a second clock signal CLK2 through a second clock signal providing line L3. Further, stages that do not receive the start signal FLM, e.g., each of the stages 120, 140, 160 may receive a carry signal CARRY from a previous stage through a carry signal providing line L4. Each of the stages 120, 140, 160 may also receive a first voltage (e.g. VGL) through a first voltage providing line and a second voltage (e.g. VGH) through a second voltage providing line (e.g., see FIG. 2). The first voltage VGL may be lower than the second voltage VGH.

The first stage 120 may generate the first emission control signal EM1 based on the start signal FLM, the first clock signal CLK1, and the second clock signal CLK2 from a timing controller. The first emission control signals EM1 generated in the first stage 120 may be provided to pixels coupled to a first emission control line EML1 through the first emission control line EML1. Further, the first stage 120 may generate and provide a first carry signal CARRY1 to the second stage 140.

The second stage 140 may generate the second emission control signal EM2 based on the first carry signal CARRY1 from the first stage 120, the first clock signal CLK1, and the second clock signal CLK2 from the timing controller. The second emission control signal EM2 generated in the second stage 140 may be provided to pixels coupled to a second emission control line EML2 through the second emission control line EML2. Further, the second stage 140 may generate and provide a second carry signal CARRY2 to the third stage 160.

The third stage 160 may generate the third emission control signal EM3 based on the second carry signal CARRY2 from the second stage 140, the first clock signal CLK1, and the second clock signal CLK2 from the timing controller. The third emission control signal EM3 generated in the third stage 160 may be provided to pixels coupled to the third emission control line EML3 through the third emission control line EML3. Further, the third stage 160 may generate and provide the third carry signal CARRY3 to a fourth stage.

As described above, the stages of the emission control driver 100 may sequentially output the emission control signals EM1, EM2, EM3. The first stage 120 may generate the first emission control signal EM1 based on the start signal FLM, the first clock signal CLK1, and the second clock signal CLK2. The Nth stage may generate an Nth emission control signal EMN based on an (N−1)th carry signal, the first clock signal CLK1, and the second clock signal CLK2, where N is an integer equal to or greater than 2.

Figure 2:
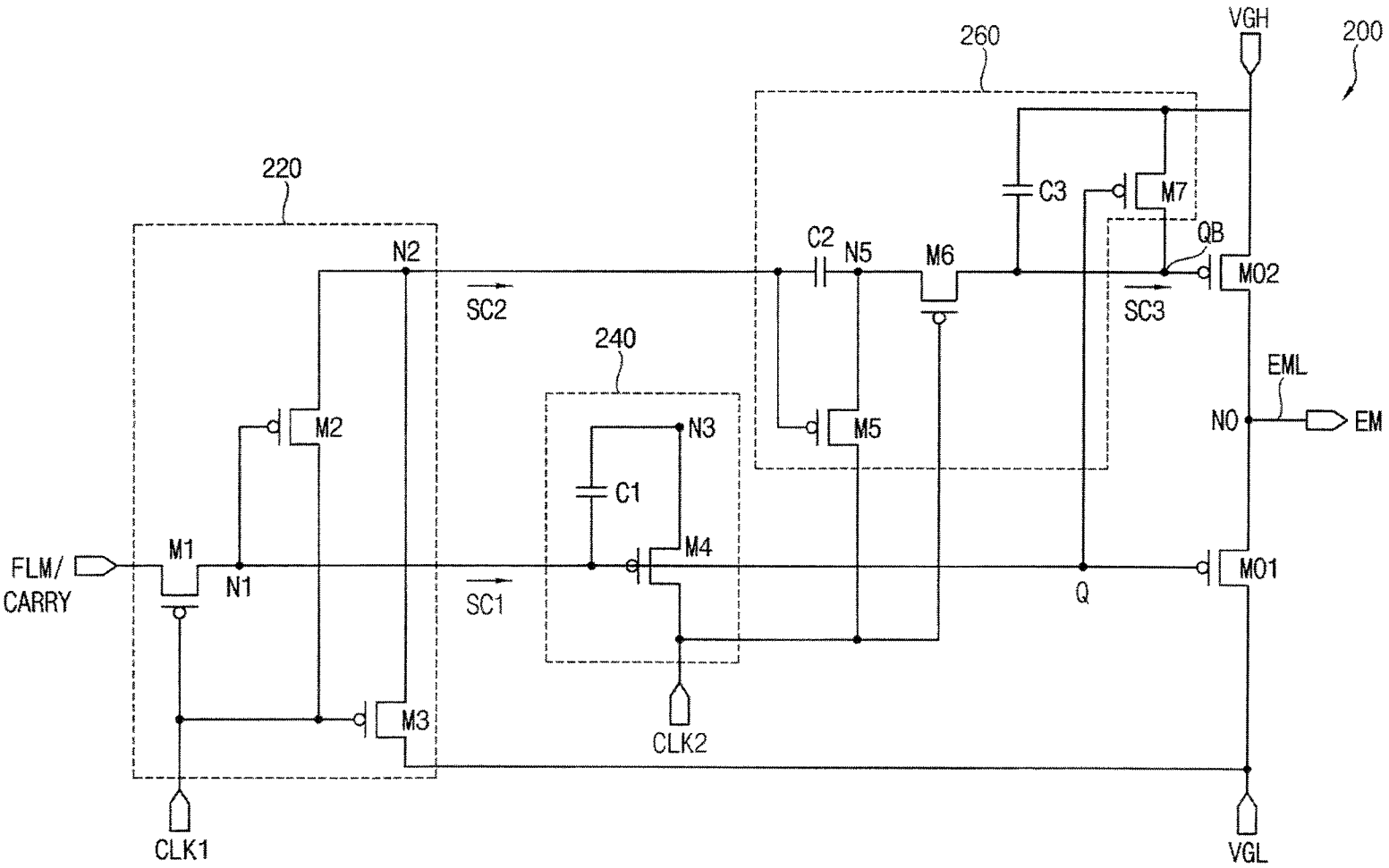
FIG. 2 illustrates an embodiment of a stage in the emission control driver.
Figure 3:
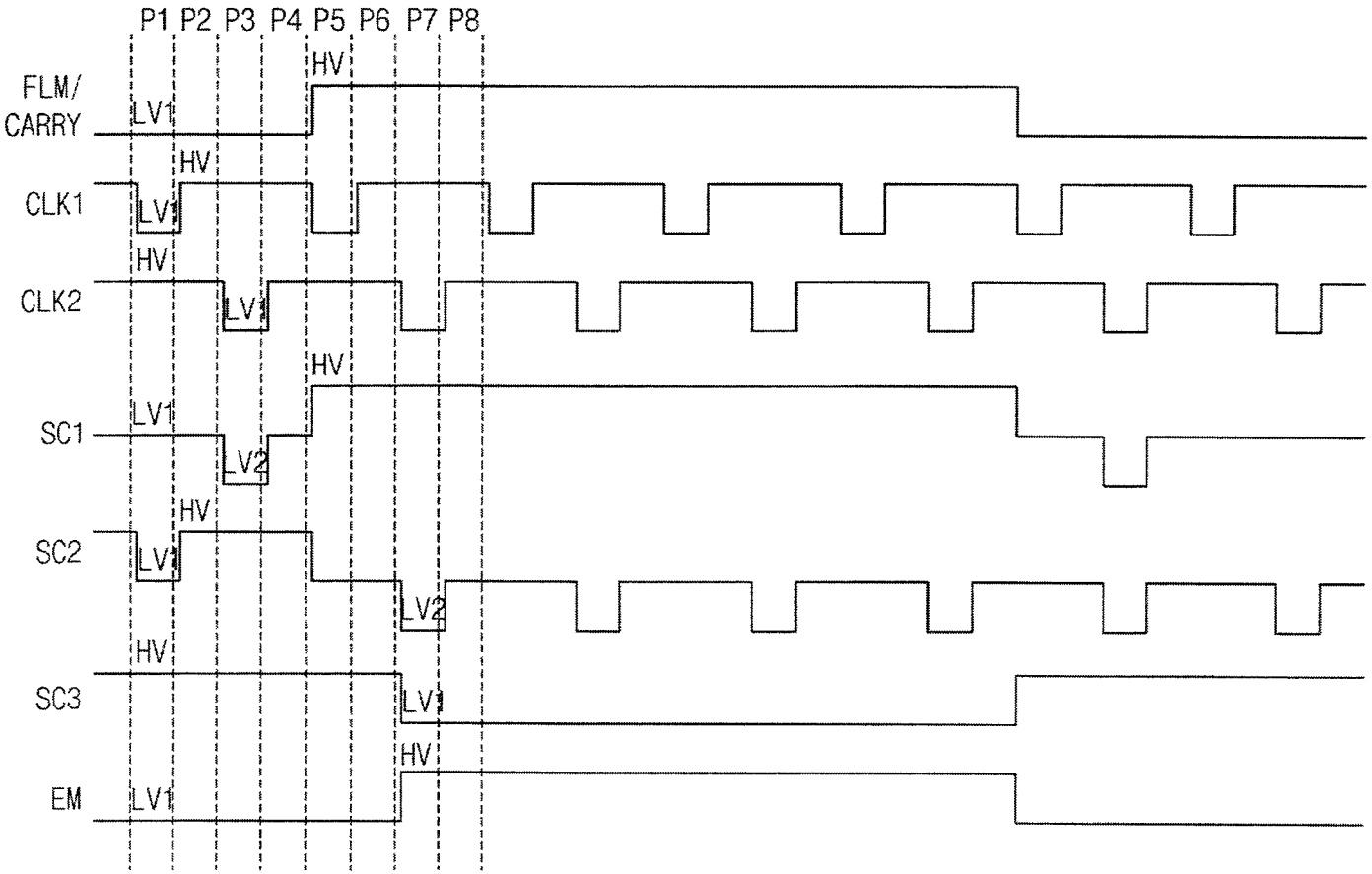
FIG. 3 illustrates an embodiment of signals for controlling the stage.

FIG. 2 illustrates an embodiment of a stage 200, which, for example, may be representative of the stages in the emission control driver 100. FIG. 3 illustrates an embodiment of a timing diagram for the stage in FIG. 2.

Referring to FIG. 2, the stage 200 may include a first circuit block 220, a second circuit block 240, a third circuit block 260, a first output transistor MO1, and a second output transistor MO2. The first circuit block 220 may generate a first control signal SC1 and a second control signal SC2 based on a first clock signal CLK1 and a start signal FLM or a carry signal CARRY[N−1]. The first control signal SC1 and the second control signal SC2 may have a low level voltage or a high level voltage for controlling operation of a switching transistor. When the stage 200 is first stage 120 in FIG. 1, the start signal FLM may be provided to the first circuit block 220. When the stage 200 is an Nth stage (e.g., second stage 140) in FIG. 1, the (N−1)th carry signal (e.g., the first carry signal CARRY1) may be provided to the first circuit block 220.

The first circuit block 220 may include a first switching transistor M1, a second switching transistor M2, and a third switching transistor M3. The first switching transistor M1 may turn on or turn off based on the first clock signal CLK1. The first switching transistor M1 may be coupled between a first node N1 and a start signal providing line or a carry signal providing line. The first switching transistor M1 may have a gate electrode coupled to a first clock signal providing line, a first electrode coupled to a start signal providing line or a carry signal providing line, and a second electrode coupled to the first node N1. When the first switching transistor M1 turns on, the start signal FLM provided through the start signal providing line or the carry signal CARRY provided through the carry signal providing line may be provided to the first node N1.

The second switching transistor M2 may turn on or turn off based on a voltage of the first node N1. The second switching transistor M2 may be coupled between the first clock signal providing line and the second node N2. The second switching transistor M2 may have a gate electrode coupled to the first node N1, a first electrode coupled to a second node N2, and a second electrode coupled to the first clock signal providing line. When the second switching transistor M2 turns on, the first clock signal CLK1 provided through a first clock signal providing line may be provided to the second node N2. The third switching transistor M3 may turn on or turn off based on first clock signal CLK1.

The third switching transistor M3 may be coupled between the second node N2 and a first voltage providing line. The third switching transistor M3 may have a gate electrode coupled to the first clock signal providing line, a first electrode coupled to the second node N2, and a second electrode coupled to the first voltage providing line. When the third switching transistor M3 turns on, a first voltage VGL provided through the first voltage providing line may be provided to the second node N2. The voltage of the first node N1 of the first circuit block 220 may be provided to the second circuit block 240 as a first control signal SC1. The voltage of the second node N2 of the first circuit block 220 may be provided to the third circuit block 260 as a second control signal SC2.

The second circuit block 240 may control a voltage level of the first control signal SC1 based on the first control signal SC1 and a second clock signal CLK2. The second circuit block 240 may include a fourth switching transistor M4 and a first capacitor. The fourth switching transistor M4 may turn on or turn off based on the first control signal SC1.

The fourth switching transistor M4 may be coupled between a second clock providing line and a third node N3. The fourth switching transistor M4 may include a gate electrode coupled to the first node N1, a first electrode coupled to the second clock signal providing line, and a second electrode coupled to the third node N3. When the fourth switching transistor M4 turns on, the second clock signal CLK2 provided through the second clock signal providing line may be provided to the third node N3.

The first capacitor C1 may be coupled between the first node N1 and the third node N3. The first capacitor C1 may include a first electrode coupled to the first node N1 and a second electrode coupled to the third node N3. The voltage level of the first control signal SC1 may be controlled by the first capacitor C1 charged or discharged.

The third circuit block 260 may generate a third control signal SC3 based on the second control signal SC2 and the second clock signal CLK2. The third control signal SC3 may have a low level voltage or a high level voltage in order to control operation of a switching transistor. The third circuit block 260 may include a fifth switching transistor M5, a second capacitor C2, a sixth switching transistor M6, a seventh switching transistor M7, and a third capacitor C3.

The fifth switching transistor M5 may turn on or turn off based on the second control signal SC2. The fifth switching transistor M5 may be coupled between the second clock signal providing line and a fifth node N5. The fifth switching transistor M5 may have a gate electrode coupled to the second node N2, a first electrode coupled to the second clock signal providing line, and a second electrode coupled to the fifth node N5. When the fifth switching transistor M5 turns on, the second clock signal CLK2 may be provided to the fifth node N5.

The second capacitor C2 may be coupled between the second node N2 and the fifth node N5. The second capacitor C2 may include a first electrode coupled to the second node N2 and a second electrode coupled to the fifth node N5.

The sixth switching transistor M6 may turn on or turn off based on the second clock signal CLK2. The sixth switching transistor M6 may be coupled between the fifth node N5 and a second output node QB. The sixth switching transistor M6 may include a gate electrode coupled to the second clock signal providing line, a first electrode coupled to the fifth node N5, and a second electrode coupled to the second output node QB. When the sixth switching transistor M6 turns on, a voltage of the fifth node N5 may be provided to the second output node QB.

The seventh switching transistor M7 may turn on or turn off based on the first control signal SC1. The seventh switching transistor M7 may be coupled between a second voltage providing line that provides a second voltage VGH and the second output node QB. The seventh switching transistor M7 may include a gate electrode coupled to a first output node Q, a first electrode coupled to the second voltage providing line, and a second electrode coupled to the second output node QB. When the seventh switching transistor M7 turns on, the second voltage VGH may be provided to the second output node QB.

The third capacitor C3 may be coupled between the second voltage providing line and the second output node QB. The third capacitor C3 may have a first electrode coupled to the second voltage providing line and a second electrode coupled to the second output node QB.

A first output transistor MO1 may output the first voltage VGL as an emission control signal EM based on the first control signal SC1 provided to the first output node Q. The first output transistor MO1 may have a gate electrode coupled to the first output node Q, a first electrode coupled to an emission control line EML, and a second electrode coupled to the first voltage providing line.

The second output transistor MO2 may output the second voltage VGH as the emission control signal EM based on the third control signal SC3 provided to the second output node QB. The second output transistor MO2 may include a gate electrode coupled to the second output node QB, a first electrode coupled to the second voltage providing line, and a second electrode coupled to the emission control line EML.

The second circuit block 240 may maintain the voltage level of the first control signal SC1 while the first output transistor MO1 turns off. For example, the voltage of the first node N1 may be coupled with the voltage of the third node N3 by the first capacitor C1 of the second circuit block 240 while the first output transistor MO1 turns on. The voltage of the first output node Q may be maintained while the first output transistor MO1 turns off.

Referring to FIG. 2, the first through seventh switching transistor M1, . . . , M7, the first output transistor MO1, and the second output transistor MO2 may be implemented as a PMOS (P-channel Metal Oxide-Semiconductor) transistor. In this case, the first through seventh switching transistor M1, . . . , M7, the first output transistor MO1, and the second output transistor MO2 may turn on based on a signal having a low level voltage (e.g., VGL). In another embodiment, the first through seventh switching transistor M1, . . . , M7, the first output transistor MO1, and the second output transistor MO2 may be a NMOS(N-channel Metal Oxide-Semiconductor) transistors. In this case, the first through seventh switching transistor M1, . . . , M7, the first output transistor MO1, and the second output transistor MO2 may turn on based on a signal having a high level voltage (e.g., VGH).

Referring to FIG. 3, the first clock signal CLK1 and the second clock signal CLK2 may have the same period. The second clock signal CLK2 may be shifted as a predetermined period to the first clock signal CLK1.

The start signal FLM or the carry signal CARRY having a first low level LV1 and the first clocks signal CLK1 having a first low level LV1, and the second clock signal CLK2 having a high level HV may be provided to stage 200 of the emission control driver in a first period P1. The first low level LV1 may be a voltage level that turns on the switching transistor.

The first circuit block 220 may generate the first control signal SC1 and the second control signal SC2 having the first low level LV1 in the first period P1. The first switching transistor M1 may turn on based on the first clock signal CLK1 having the first low level LV1 in the first period P1. When the first switching transistor M1 turns on, the start signal FLM or the carry signal CARRY provided to the first electrode of the first switching transistor M1 may be provided to the first node N1 coupled to the second electrode of the first switching transistor M1. Thus, the start signal FLM or the carry signal CARRY having the first low level LV may be provided to the first node N1. The voltage of the first node N1 having the first low level LV1 may be provided to the first output node Q as the first control signal SC1.

The second switching transistor M2 may turn on based on the voltage of the first node N1 (e.g., the first control signal SC1) having the first low level LV1. When the second switching transistor M2 turns on, the first clock signal CLK1 provided to the second electrode of the second switching transistor M2 may be provided to the second node N2 coupled to the first electrode of the second switching transistor M2. Thus, the first clock signal CLK1 having the first low level LV1 may be provided to the second node N2. The voltage of the second node N2 having the first low level LV1 may output as the second control signal SC2.

The third switching transistor M3 may turn on based on the first clock signal CLK1 having the first low level LV1. When the third switching transistor M3 turns on, the first voltage VGL provided to the second electrode of the third switching transistor M3 may be provided to the second node N2 coupled to the first electrode of the third switching transistor M3.

The first capacitor C1 of the second circuit block 240 may be charged in the first period P1. The fourth switching transistor M4 may turn on based on the first control signal SC1 having the first low level LV1 in the first period P1. When the fourth switching transistor M4 turns on, the second clock signal CLK2 provided to the first electrode of the fourth switching transistor M4 may be provided to the third node N3 coupled to the second electrode of the fourth switching transistor M4. Thus, the second clock signal CLK2 having the high level HV.

The first capacitor C1 may store a voltage difference between the control signal SC1 having the first low level LV1 provided to the first node N1 and the second clock signal having the high level HV provided to the third node N3.

The third circuit block 260 may generate the third control signal SC3 having the high level HV in the first period P1. The fifth switching transistor M5 may turn on based on the second control signal SC2 having the first low level LV1 in the first period P1. When the fifth switching transistor M5 turns on, the second clock signal CLK2 provided to the first electrode of the fifth switching transistor M5 may be provided to the fifth node N5 coupled to the second electrode of the fifth switching transistor M5. Thus, the second clock signal CLK2 having the high level HV may be provided to fifth node N5.

The second capacitor C2 may store a voltage difference between the second control signal SC2 having the first low level LV1 provided to the second node N2 and the second clock signal having the high level HV provided to the fifth node N5.

The sixth switching transistor M6 may turn off based on the second clock signal CLK2 having the high level HV.

The seventh switching transistor M7 may turn on based on the first control signal SC1 having the first low level LV1 in the first period P1. When the seventh switching transistor M7 turns on, the second voltage VGH provided to the first electrode of the seventh switching transistor M7 may be provided to the second output node QB coupled to the second electrode of the seventh switching transistor M7. Thus, the second voltage VGH having the high level HV may be provided to the second output node QB as the third control signal SC3.

The first output transistor MO1 may turn on based on the first control signal having the first low level LV1. When the first output transistor MO1 turns on, the first voltage VGL provided to the second electrode of the first output transistor MO1 may be provided to the emission control line EML coupled to the first electrode of the first output transistor MO1. Thus, the first voltage VGL having the first low level LV1 may be output as the emission control signal EM. The second output transistor MO2 may turn off based on the third control signal SC3 having the high level HV.

The start signal FLM or the carry signal CARRY having the first low level LV1, the first clock signal CLK1 having the high level HV, and the second clock signal CLK2 having the high level HV may be provided to the stage 200 of the emission control driver in the second period P2.

The first circuit block 220 may generate the first control signal SC1 having the first low level LV1 and the second control signal SC2 having the high level HV in the second period P2. The first switching transistor M1 may turn off based on the first clock signal CLK1 having the high level HV. The first low voltage level LV1 of the voltage of the first node N1 may be maintained by the first capacitor C1.

The voltage of the first node N1 having the first low level LV1 may be provided to the first output node Q as the first control signal SC1. The second switching transistor M2 may turn on based on the first control signal SC1 (e.g., the voltage of the first node) having the first low level LV1. When the second switching transistor M2 turns on, the first clock signal CLK1 provided to the second electrode of the second switching transistor M2 may be provided to the second node N2 coupled to the first electrode of the second switching transistor M2. Thus, the first clock signal CLK1 having the high level HV may be provided to the second node N2. The voltage of the second node N2 having the high level HV may be output as the second control signal SC2. The third switching transistor M3 may turn off based on the first clock signal CLK1 having the high level HV.

The first capacitor C1 of the second circuit block 240 may maintain the voltage of the first node N1 in the second period P2. The fourth switching transistor M4 may turn on based on the first control signal SC1 having the first low level in the second period P2. When the fourth switching transistor M4 turns on, the second clock signal CLK2 provided to the first electrode of the fourth switching transistor M4 may be provided to the third node N3 coupled to the second electrode of the fourth switching transistor M4. Thus, the second clock signal CLK2 having the high level HV may be provided to the third node N3. The voltage of the first node N1 may be maintained by the charged voltage in the first capacitor C1.

The third circuit block 260 may generate the third control signal SC3 having the high level HV in the second period P2. The fifth switching transistor M5 may turn off based on the second control signal SC2 having the high level HV in the second period.

The sixth switching transistor M6 may turn off based on the second clock signal CLK2 having the high level HV.

The seventh switching transistor M7 may turn on based on the first control signal SC1 having the first low level LV1 in the second period P2. When the seventh switching transistor M7 turns on, the second voltage VGH provided to the first electrode of the seventh switching transistor M7 may be provided to the second output node QB coupled to the second electrode of the seventh switching transistor M7. Thus, the second voltage VGH having the high level may be provided to the second output node QB. The second voltage VGH having the high level HV may be provided to the second output node QB as the third control signal SC3.

The first output transistor MO1 may turn on based on the first control signal SC1 having the first low level LV1 in the second period P2. When the first output transistor MO1 turns on, the first voltage VGL provided to the second electrode of the first output transistor MO1 may be provided to the emission control line EML coupled to the first electrode of the first output transistor MO1. Thus, the first voltage VGL having the first low level LV1 may be output as the emission control signal EM. The second output transistor MO2 may turn off based on the third control signal SC3 having the high level HV.

The start signal FLM or the carry signal CARRY having the first low level LV1, the first clock signal CLK1 having the high level HV, and the second clock signal CLK2 having the first low level LV1 may be provided to the stage 200 of the emission control driver in the third period P3.

The first circuit block 220 may generate the first control signal SC1 having the second low level LV2 and the second control signal SC2 having the high level HV. The second low level LV2 is lower than the first low level LV1. The first switching transistor M1 and the third switching transistor M3 may turn off based on the first clock signal CLK1 having the high level HV. The voltage of the first node N1 may be maintained at the first low level LV1 by the first capacitor C1. The voltage of the first node N1 may be provided to the first output node Q as the first control signal SC1.

The second switching transistor M2 may turn on based on the first control signal SC1 (e.g., the voltage of the first node ND having the first low level LV1. When the second switching transistor M2 turns on, the first clock signal CLK1 provided to the second electrode of the second switching transistor M2 may be provided to the second node N2 coupled to the first electrode of the second switching transistor M2. Thus, the first clock signal CLK1 having the high level HV may be provided to the second node N2. The voltage of the second node N2 having the high level HV may be output as the second control signal SC2.

The voltage of the first node N1 may be coupling by the first capacitor C1 of the second circuit block 240 in the third period P3.

The fourth switching transistor M4 may turn on based on the first control signal SC1 having the first low level LV1. When the fourth switching transistor M4 turns on, the second clock signal CLK2 provided to the first electrode of the fourth switching transistor M4 may be provided to the third node N3 coupled to the second electrode of the fourth switching transistor M4. The voltage of the first node N1 may be coupling by the first capacitor C1 because the voltage having the first low level LV is provided to the third node N3. The voltage of the first node N1 may fall as the voltage charged in the first capacitor C1. Thus, the voltage of the first node N1 may be changed to the second low level LV2, and the voltage level of the first control signal SC1 may be changed by the second circuit block 260. The first control signal SC1 having the second low level LV2 may be provided to the first output node Q. Therefore, the first output transistor MO1 may be stably driven.

The third circuit block 260 may generate the control signal SC3 having the high level HV in the third period P3. The fifth switching transistor M5 may turn off based on the second control signal SC2 having the high level HV in the third period P3. The sixth switching transistor M6 may turn on based on the second clock signal CLK2 having the first low level LV1. The voltage of the fifth node N5 is maintained by the second capacitor C2. When the sixth switching transistor M6 turns on the voltage of the fifth node N5 having the high level HV may be provided to the second output node QB as the third control signal SC3.

The seventh switching transistor M7 may turn on based on the first control signal SC1 having the second low level LV2 in the third period P3. When the seventh switching transistor M7 turns on, the second voltage VGH provided to the first electrode of the seventh switching transistor M7 may be provided to the second output node QB coupled to the second electrode of the seventh switching transistor M7. Thus, the second voltage VGH having the high level HV may be provided to the second output node QB. Thus, the second voltage VGH having the high level HV may be provided to the second output node QB as the third control signal.

The first output transistor MO1 may turn on based on the first control signal SC1 having the second low level LV2 in the third period P3. When the first output transistor MO1 turns on, the first voltage VGL provided to the second electrode of the first output transistor MO1 may be provided to the emission control line EML coupled to the first electrode of the first output transistor MO1. Thus, the first voltage VGL having the first low level LV1 may be output as the emission control signal EM. The second output transistor MO2 may turn off based on the third control signal SC3 having the high level HV in the third period P3.

The start signal FLM or the carry signal CARRY having the first low level LV1, the first clock signal CLK1 having the high level HV, and the second clock signal CLK2 having the high level HV may be provided to the stage 200 of the emission control driver in the fourth period P4.

The first circuit block 220 may generate the first control signal SC1 having the first low level LV1 and the second control signal SC2 having the high level HV in the fourth period P4. The first switching transistor M1 and the third switching transistor M3 may turn off based on the first clock signal having the high level HV in the fourth period P4. The voltage of the first node N1 may be maintained as the second low level LV2 by the first capacitor C1. The voltage of the first node N1 may be provided to the first output node Q as the first control signal SC1.

The second switching transistor M2 may turn on based on the first control signal SC1 (e.g., the voltage of the first node N2). When the second switching transistor M2 turn on, the first clock signal CLK1 provided to the second electrode of the second switching transistor M2 may be provided to the second node N2 coupled to the first electrode of the second switching transistor M2. Thus, the first clock signal CLK1 having the high level HV may be provided to the second node N2. The voltage of the second node N2 having the high level HV may be output as second control signal SC2.

The voltage of the first node N1 may be coupling by the first capacitor C1 of the second circuit block in the fourth period P4. The fourth switching transistor M4 may turn on based on the first control signal SC1 having the second low level LV2. When the fourth switching transistor M4 turns on, the second clock signal CLK2 provided to the first electrode of the fourth switching transistor M4 may be provided to the third node N3 coupled to the second electrode of the fourth switching transistor M4. Thus, the second clock signal CLK2 having the high level HV may be provided to the third node N3. The voltage of the first node N1 may be coupling by the first capacitor because the voltage having the high level HV is provided to the third node N3. Thus, the voltage of the first node N1 may be risen as the voltage charged in the first capacitor C1. The voltage of the first node N1 may be changed to the first low level LV1. Thus, the voltage level of the first control signal SC1 may be changed by the second circuit block 260. The first control signal SC1 having the first low level LV1 may be provided to the first output node Q.

The third circuit block 260 may generate the third control signal SC3 having the high level HV in the fourth period P4. The fifth switching transistor M5 may turn off based on the second control signal SC2 having the high level HV.

The sixth switching transistor M6 may turn off based on the second clock signal CLK2 having the high level HV.

The seventh switching transistor M7 may turn on based on the first control signal SC1 having the first low level LV1. When the seventh switching transistor M7 turns on, the second voltage VGH provided to the first electrode of the seventh switching transistor M7 may be provided to the second output node QB coupled to the second electrode of the seventh switching transistor M7. Thus, the second voltage VGH having the high level HV may be provided to the second output node QB. Thus, the second voltage VGH having the high level HV may be provided to the second output node QB as the third control signal SC3.

The first output transistor MO1 may turn on based on the first control signal SC1 having the first low level LV1 in the fourth period P4. When the first output transistor MO1 turns on, the first voltage VGL provided to the second electrode of the first output transistor MO1 may be provided to the emission control line EML coupled to the first electrode of the first output transistor MO1. Thus, the first voltage VGL having the first low level LV1 may be output as the emission control signal EM. The second output transistor MO2 may turn off based on the third control signal SC3 having the high level HV in the fourth period P4.

The start signal FLM or the carry signal CARRY having the high level HV, the first clock signal CLK1 having the first low level LV1, and the second clock signal CLK2 having the high level HV may be provided to the stage 200 of the emission control driver in the fifth period P5.

The first circuit block 220 may generate the first control signal SC1 having the high level HV and the second control signal SC2 having the low level in the fifth period P5. The first switching transistor M1 may turn on based on the first clock signal CLK1 having the first low level LV1 in the fifth period P5. When the first switching transistor M1 turns on, the start signal FLM or the carry signal CARRY provided to the first electrode of the first switching transistor M1 may be provided to the first node N1 coupled to the second electrode of the first switching transistor M1. Thus, the start signal FLM or the carry signal CARRY may be provided to the first node N1.

The voltage of the first node N1 having the high level HV may be provided to the first output node Q as the first control signal SC1. The second switching transistor M2 may turn off based on the first control signal SC1 (e.g., the voltage of the first node N1) having the high level HV.

The third switching transistor M3 may turn on based on the first clock signal CLK1 having the first low level LV1. When the third switching transistor M3 turns on, the first voltage VGL provided to the second electrode of the third switching transistor M3 may be provided to the second node N2 coupled to the first electrode of the third switching transistor M3. The voltage of the second node N2 having the first low level LV1 may be output as the second control signal SC2.

The fourth switching transistor M4 of the second circuit block 240 may turn off based on the first control signal SC1 having the high level HV in the fifth period P5.

The third circuit block 260 may generate the third control signal SC3 having the high level HV in the fifth period P5.

The fifth switching transistor M5 may turn on based on the second control signal SC2 having the first low level LV1 in the fifth period P5. When the fifth switching transistor M5 turns on, the second clock signal CLK2 provided to the first electrode of the fifth switching transistor M5 may be provided to the fifth node N5 coupled to the second electrode of the fifth switching transistor M5. Thus, the second clock signal CLK2 having the high level HV may be provided to fifth node N5.

The second capacitor may store the voltage difference between the second control signal SC2 having the first low level LV1 provided to the second node N3 and the second clock signal 1CLK2 having the high level HV provided to the fifth node N5.

The sixth switching transistor M6 may turn off based on the second clock signal CLK2 having the high level HV.

The seventh switching transistor M7 may turn off based on the first control signal SC1 having the high level HV in the fifth period P5. The second voltage VGH may be provided to the second output node QB through the third capacitor C3. Thus, the second voltage VGH having the high level may be provided to the second output node QB as the third control signal SC3.

The first output transistor MO1 may turn off based on the first control signal SC1 having the high level in the fifth period P5. Further, the second output transistor MO2 may turn off based on the third control signal SC3 having the high level HV. The emission control signal EM having the first low level LV may be output through the emission control line EML in the fifth period P5.

The start signal FLM or the carry signal CARRY having the high level HV, the first clock signal CLK1 having the high level HV, and the second clock signal CLK2 having the high level HV may be provided to the stage 200 of the emission control driver in the sixth period P6.

The first circuit block 220 may generate the first control signal having the high level HV and the second control signal SC2 having the first low level LV in the sixth period P6. The first switching transistor M1 may turn off based on the first clock signal CLK1 having the high level HV. The voltage of the first node N1 may be maintained at the high level HV by the first capacitor C1. The voltage of the first node N1 having the high level HV may be output as the first control signal SC1.

The second switching transistor M2 may turn off based on the first control signal SC1 (e.g., the voltage of the first node N1) having the high level HV. Further, the third switching transistor M3 may turn off based on the first clock signal CLK1 having the high level HV. The voltage of the second node N2 may be maintained at the first low level LV1 by the second capacitor C2. The voltage of the second node N2 having the first low level LV1 may be output as the second control signal SC2.

The fourth switching transistor M4 of the second circuit block 240 may turn off based on the first control signal SC1 having the high level in the sixth period P6. The voltage of first node N1 may be maintained at the high level HV by first capacitor C1.

The third circuit block 260 may generate the third control signal SC3 having the high level HV in the sixth period P6.

The fifth switching transistor M5 may turn on based on the second control signal SC2 having the first low level LV1 in the sixth period P6. When the fifth switching transistor M5 turns on, the second clock signal CLK2 provided to the first electrode of the fifth switching transistor M5 may be provided to the fifth node N5 coupled to the second electrode of the fifth switching transistor M5. Thus, the second clock signal CLK2 having the high level HV may be provided to the fifth node N5.

The second capacitor C2 may store the voltage difference between the second control signal SC2 having the first low level LV1 provided to the second node N2 and the second clock signal CLK2 having the high level HV provided to the fifth node N5.

The sixth switching transistor M6 may turn off based on the first control signal SC1 having the high level in the sixth period P6. The second voltage VGH may be provided to the second output node QB through the third capacitor C3. Thus, the second voltage VGH having the high level HV may be provided to the second output node QB as the third control signal SC3.

The first output transistor MO1 may turn off based on the first control signal SC1 having the high level HV in the sixth period P6. Further, the second output transistor MO2 may turn off based on the third control signal SC3 having the high level. Thus, the emission control signal EM having the first low level LV1 may be output through the emission control line EML in the sixth period P6.

The start signal FLM or the carry signal CARRY having the high level HV, the first clock signal CLK1 having the high level HV, and the second clock signal CLK2 having the first low level LV1 may be provided to the stage 200 of the emission control driver in the seventh period P7.

The first circuit block 220 may generate the first control signal SC1 having the high level HV and the second control signal SC2 having the second low level LV2. The first switching transistor M1 may turn off based on the first clock signal CLK1 having the high level in the seventh period P7. The voltage of the first node N1 may maintained as the high level by the first capacitor C1. The voltage of the first node N1 having the high level HV may be output as the first control signal SC1.

The second switching transistor M2 may turn off based on the first control signal SC1 (e.g., the voltage of the first node N1) having the high level HV. Further, the third switching transistor M3 may turn off based on the first clock signal CLK1 having the high level HV. The voltage of the second node N2 may be maintained as the first low level LV1. The voltage of the second node N2 having the first low level LV1 may be output as the second control signal SC2.

The fourth switching transistor M4 of the second circuit block 240 may turn off based on the first control signal SC1 having the high level HV in the seventh period P7. The voltage of the first node N1 may be maintained as the high level HV by the first capacitor C1.

The third circuit block 260 may generate the third control signal SC3 having the first low level LV1 in the seventh period P7.

The fifth switching transistor M5 may be turn on based on the second control signal SC2 having the first low level in the seventh period P7. When the fifth switching transistor M5 turns on, the second clock signal CLK2 provided to the first electrode of the fifth switching transistor M5 may be provided to the fifth node N5 coupled to the second electrode of the fifth switching transistor M5. Thus, the second clock signal CLK2 having the first low level LV1 may be provided to the fifth node N5. The voltage of the second node N2 may be coupling by the second capacitor C2 because the voltage having the first low level LV is provided to the fifth node N5. Thus, the voltage of the second node N2 may fall as the voltage charged in the second capacitor C2.

The voltage of the second node N2 may be changed to second low level LV2.

The sixth switching transistor M6 may turn on based on the second clock signal CLK2 having the first low level LV1 in the seventh period P7. When the sixth switching transistor M6 turns on, the voltage of the fifth node N5 having the first low level LV1 may be provided to the second output node QB as the third control signal SC3. The seventh switching transistor M7 may turn off based on the first control signal SC1 having the high level HV in the seventh period P7.

The first output transistor MO1 may turn off based on the first control signal SC1 having the high level HV in the seventh period P7. Further, the second output transistor MO2 may turn on based on the third control signal SC3 having the first low level. When the second output transistor MO2 turns on, the second voltage VGH provided to the second electrode of the second output transistor MO2 may be provided to the emission control line EML coupled to the first electrode of the second output transistor MO2. Thus, the second voltage VGH having the high level HV may be output as the emission control signal EM.

The start signal FLM or the carry signal CARRY having the high level HV, the first clock signal CLK1 having the high level HV, and the second clock signal CLK2 having the high level HV may be provided to the stage 200 of the emission control driver in the eighth period P8.

The first circuit block 220 may generate the first control signal SC1 having the high level HV and the second control signal SC2 having the first low level LV1 in the eighth period P8. The first switching transistor M1 may turn off based on the first clock signal CLK1 having the high level HV. The voltage of the first node N1 may be maintained at the high level by the first capacitor C1. The voltage of the first node N1 having the high level HV may be provided to the first output node Q as the first control signal SC1. The second switching transistor M2 may turn off based on the first control signal SC1 (e.g., the voltage of the first node N1) having the high level HV. Further, the third switching transistor M3 may turn off based on the first clock signal CLK1 having the high level HV.

The fourth switching transistor M4 of the second circuit block 240 may turn off based on the first control signal SC1 having the high level HV in the eighth period P8. The voltage of the first node N1 may be maintained as the high level HV by the first capacitor C1.

The third circuit block 260 may generate the third control signal SC3 having the first low level LV1 in the eighth period P8.

The fifth switching transistor M5 may turn on based on the second control signal SC2 having the second low level LV2 in the eighth period P8. When the fifth switching transistor M5 turns on, the second clock signal CLK2 provided to the first electrode of the fifth switching transistor M5 may be provided to the fifth node N5 coupled to the second electrode of the fifth switching transistor M5. Thus, the second clock signal CLK2 having the high level HV may be provided to the fifth node N5.

The voltage of the second node N2 may be coupling by the second capacitor C2 because the voltage having the high level HV is provided to the fifth node N5. Thus, the voltage of the second node 2 may rise as the voltage charged in the second capacitor C2. The voltage of the second node N2 may be changed to the first low level LV1.

The sixth switching transistor M6 may turn off based on the second clock signal CLK2 having the high level HV in the eighth period P8.

The seventh switching transistor M7 may turn off based on the first control signal SC1 having the high level HV. The second voltage VGH may be provided to the second output node QB through the third capacitor C3. Thus, the second voltage VGH having the high level HV may be provided to the second output node QB as the third control signal SC3.

The first output transistor MO1 may turn off based on the first control signal SC1 having the high level HV in the eighth period P8. Further, the second output transistor MO2 may turn on based on the third control signal SC3 having the first low level LV1. When the second output transistor MO2 turns on, the second voltage VGH provided to the second electrode of the second output transistor MO2 may be provided to the emission control line EML coupled to the first electrode of the second output transistor MO2. Thus, the second voltage VGH having the high level HV may be output as the emission control signal EM.

As described above, the second circuit block 240 may couple the first node N1 with the third node N3 while the first output transistor MO1 turns on (e.g., during the first through fourth periods), and maintain the voltage of the first node N1 while the first output transistor MO1 turns off (e.g., during the fifth through eighth periods). Thus, voltage level of the first control signal SC1 may be controlled. Therefore, the stage 200 of the emission control driver that includes the second circuit block 240 may stably drives the first output transistor MO1.

Figure 4:
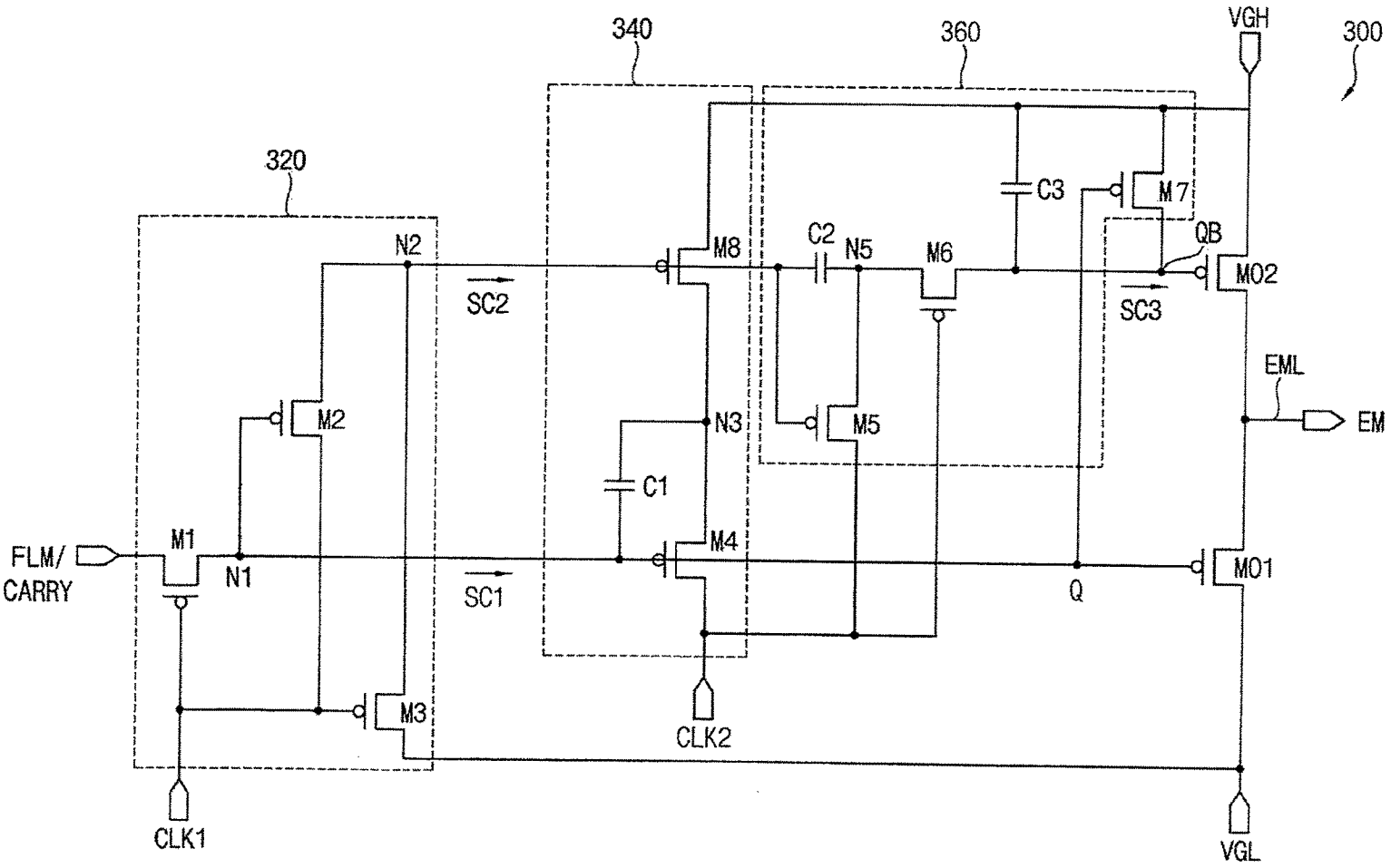
FIG. 4 illustrates another embodiment of a stage in the emission control driver.

FIG. 4 illustrates another embodiment of a stage 300 that may be representative of the stages in the emission control driver in FIG. 1. Referring to FIG. 4, the stage 300 may include a first circuit block 320, a second circuit block 340, and a third circuit block 360. The first circuit block 320 and the third circuit block 360 of the stage 300 of FIG. 4 may have the same structure of the first circuit block 220 and the third circuit block 260 of the stage 200 of FIG. 3. The second circuit block 340 of the stage 300 of FIG. 4 may have the same structure of the second circuit block 240 of the stage 200 of FIG. 3, except for an eighth switching transistor M8.

The eighth switching transistor M8 may be turn on or turn off based on the second control signal SC2. The eighth switching transistor M8 may be coupled between the second voltage providing line and the third node N3. The eighth switching transistor M8 may have a gate electrode coupled to the second node N2, a first electrode coupled to the second voltage providing line and a second electrode coupled to the third node N3. When the eighth switching transistor M8 turns on, the second voltage VGH having the high level may be provided to the third node N3 through the second voltage providing line. Thus, the eighth switching transistor M8 may stably provides the voltage having high level H to the third node N3 based on the second control signal SC2.

The eighth switching transistor M8 has a gate electrode coupled to the second node N2 in FIG. 4. In one embodiment, the gate electrode of the eighth switching transistor M8 may be coupled to the fifth node N5 or the second output node QB.

Figure 5:
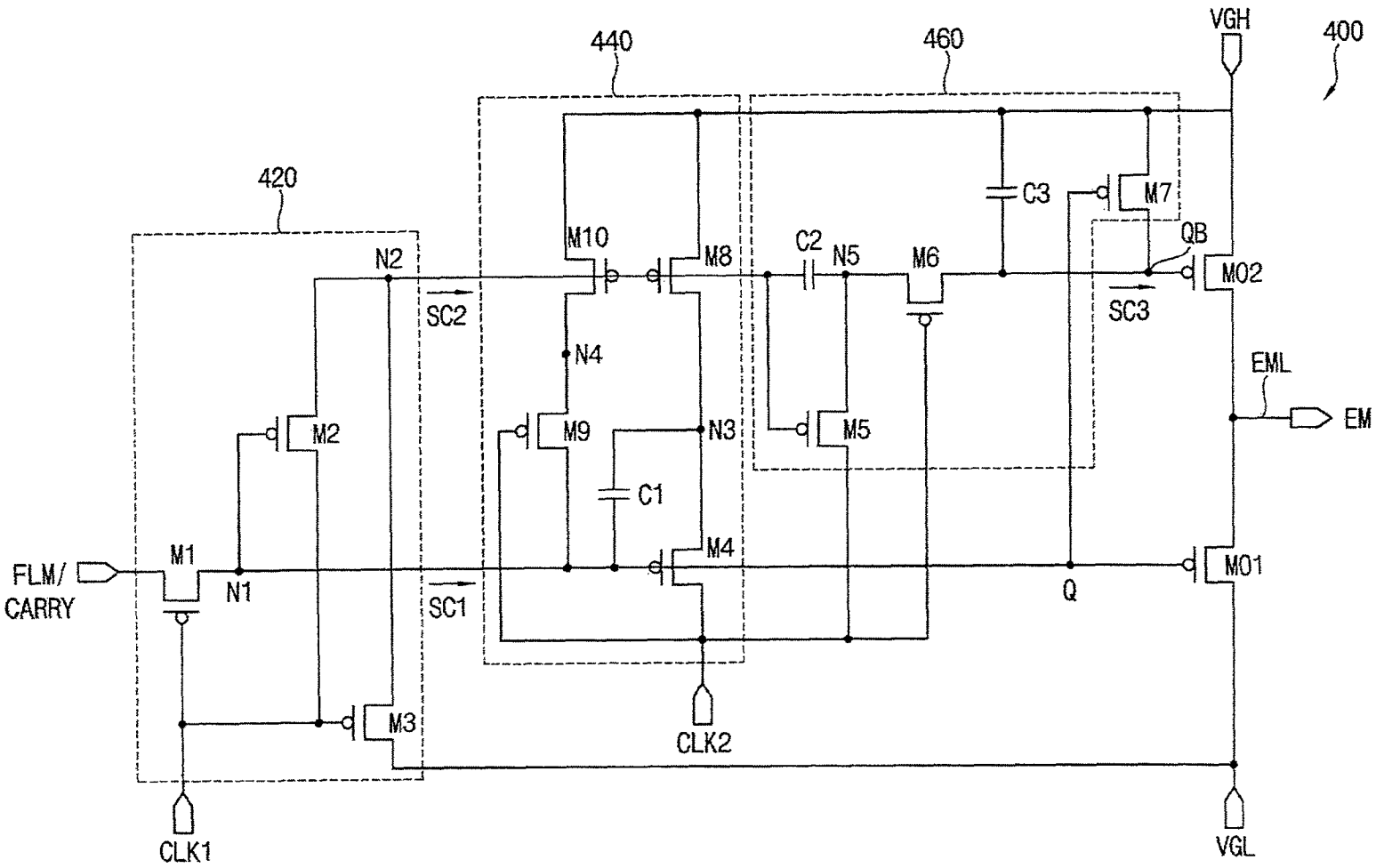
FIG. 5 illustrates another embodiment of a stage in the emission control driver.

FIG. 5 illustrates another embodiment of a stage 400 in the emission control driver in FIG. 1. Referring to FIG. 5, the stage 400 may include a first circuit block 420, a second circuit block 440, and a third circuit block 460. The first circuit block 420 and the third circuit block 460 of the stage 400 of FIG. 5 may have the same structure of the first circuit block 220 and the third circuit block 260 of the stage 200 of FIG. 3. The second circuit block 440 of the stage 400 of FIG. 5 may have the same structure of the second circuit block 340 of the stage 300 of FIG. 4, except for a ninth switching transistor M9 and a tenth switching transistor M10.

The ninth switching transistor M9 may be turn on or turn off based on the second clock signal CLK2. The ninth switching transistor M9 may be coupled between the first node N1 and the fourth node N4. The ninth switching transistor M9 may have a gate electrode coupled to the second clock providing line, a first electrode coupled to the fourth node N4, and a second electrode coupled to the first node N1. When the ninth switching transistor M9 turns on, a voltage of the fourth node N4 may be provided to the first node N1.

The tenth switching transistor M10 may be turn on or turn off based on the second control signal SC2. The tenth switching transistor M10 may be coupled between the fourth node N4 and the second voltage providing line. The tenth switching transistor M10 may have a gate electrode coupled to the second node N2, a first electrode coupled to the second voltage providing line, and a second electrode coupled to the fourth node N4. When the tenth switching transistor M10 turns on, the second voltage VGH having the high level may be provided to the fourth node N3 through the second voltage providing line. Thus, when the ninth switching transistor M9 and the tenth switching transistor M10 turn on, the voltage having the high level H may stably provided to the first node N1.

Figure 6:
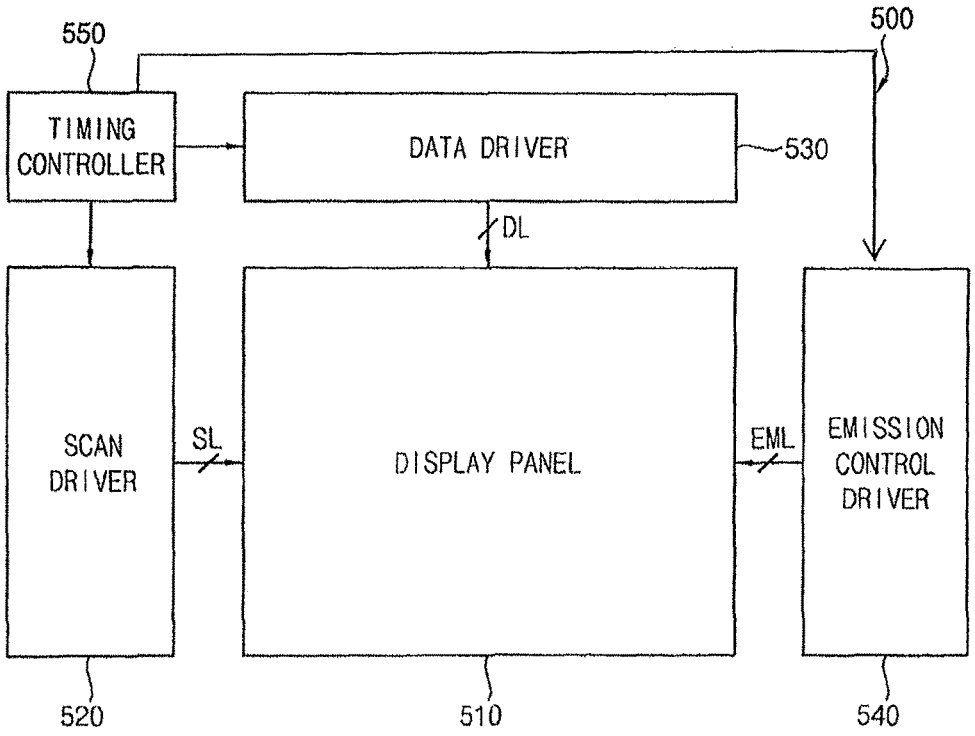
FIG. 6 illustrates an embodiment of a display device.
Figure 7:
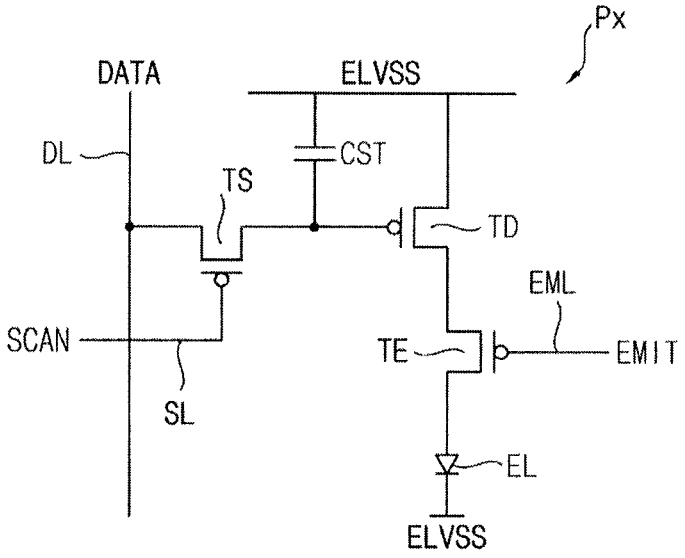
FIG. 7 illustrates an embodiment of a pixel.

FIG. 6 illustrates an embodiment of a display device 500, and FIG. 7 illustrates an embodiment of a pixel Px in the display device 500 in FIG. 6. Referring to FIG. 6, a display device 500 may include a display panel 510, a scan driver 520, a data driver 530, an emission controller 540, and a timing controller 550. The display panel 510 may include a plurality of pixels. A plurality of data lines DL and a plurality of scan lines SL may be on the display panel 510. The pixels may be at respective intersection regions of the data lines DL and scan lines SL.

Referring to FIG. 7, the pixel Px may include a driving transistor TD, a switching transistor TS, a storage capacitor CST, an emission transistor TE, and an organic light emitting diode EL. The switching transistor TS may turn on or turn off based on the scan signal SCAN provided through the scan line SL. When the switching transistor TS turns on based on the scans signal SL, the data signal DATA provided through the data line DL may be stored in the storage capacitor CST. The driving transistor TD may generate a driving current based in the data signal DATA. The emission transistor TE may turn on or turn off based on an emission control signal EMIT provided through an emission control line EML. When the emission transistor TE turns on based on the emission control signal EMIT, the driving current may be provided to the organic light emitting diode EL.

Referring to FIG. 7, the driving transistor TD, the switching transistor TS, and the emission transistor TE may be implemented as the PMOS transistors. In this case, the driving transistor ID, the switching transistor TS, and the emission transistor TE may turns on based on a signal having a low level voltage (e.g., ELVSS). The driving transistor TD, the switching transistor TS, and the emission transistor TE in FIG. 7 are PMOS transistors. In another embodiment, the driving transistor TD, the switching transistor TS, and the emission transistor TE may be NMOS transistors. In this case, the driving transistor TD, the switching transistor TS, and the emission transistor TE may turn on based on a signal having a high level voltage (e.g., ELVDD). In another embodiment, each pixel may include PMOS and NMOS transistors.

The scan driver 520 may provide the scan signal SCAN to the pixels Px through the scan lines SL. The data driver 530 may provide the data signal DATA to the pixels Px through the data lines DL. The timing controller 550 may generate control signals that control the scan driver 520, the data driver 530, and the emission control driver 540.

The emission control driver 540 may provide the emission control signal EMIT to the pixels Px through the emission control lines EML. The emission control driver 540 may include a plurality of stages. The stages may be dependently coupled. The stages may sequentially output the emission control signal EMIT. Each stage may receive a start signal or a carry signal, a first clock signal, and a second clock signal.

Each stage may include a first circuit block, a second circuit block, and a third circuit block. The first circuit block may generate a first control signal and the second control signal based on the start signal or the carry signal. The second circuit block may control a voltage level of the first control signal based on the first control signal and the second clock signal. The third circuit block may generate a third control signal based on the second control signal and the second clock signal.

A first output transistor may output a first voltage as the emission control signal EMIT based on the first control signal provided to the first output node. A second output transistor may output a second voltage as the emission control signal EMIT based on the third control signal provided to the second output node.

The second circuit block may control the voltage level of the first control signal, for example, by coupling while the first output transistor turns on. The second circuit block may maintain the voltage level of the first control signal while the first output transistor turns off Thus, the first output transistor may be stably driven.

As described above, the stages of the emission control driver 540 may stably provide the emission control signal EMIT to the display panel 510 by including the second circuit block that stably generates the emission control signal EMIT.

Figure 8:
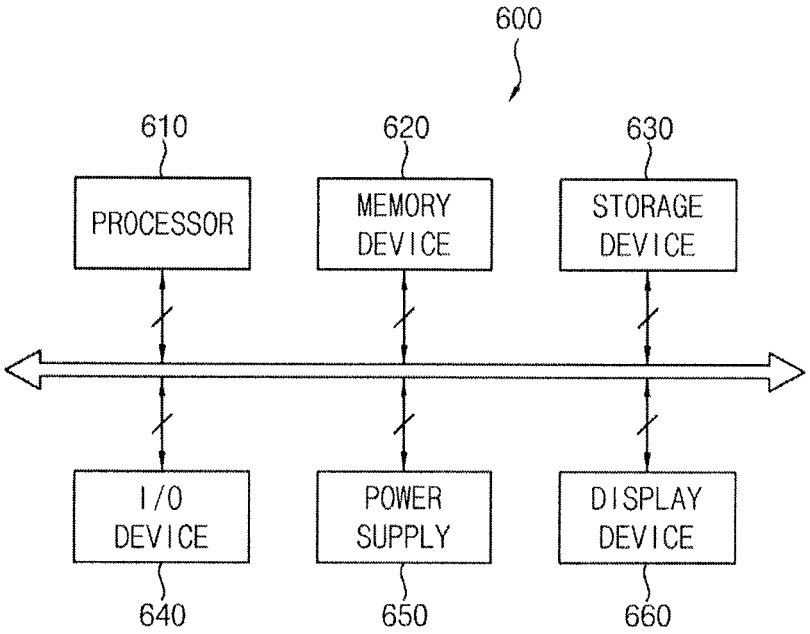
FIG. 8 illustrates an embodiment of an electronic device.
Figure 9:
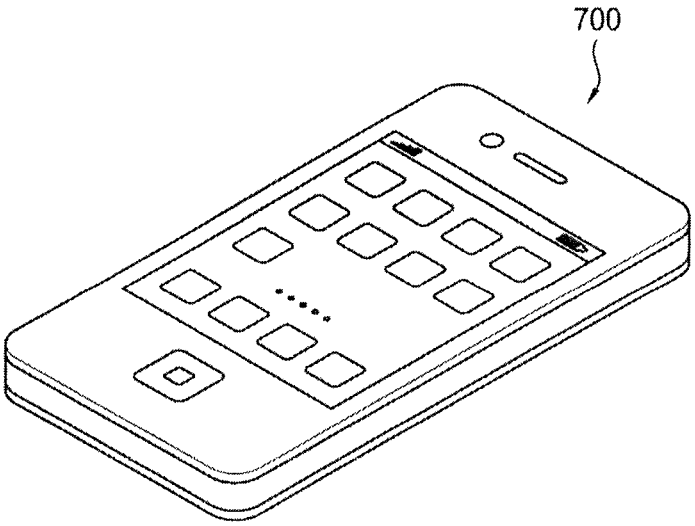
FIG. 9 illustrates an embodiment of a smart phone.

FIG. 8 illustrates an embodiment of an electronic device 600 that may include the display device in FIG. 7. FIG. 9 illustrates an example embodiment of the electronic device 600 in the form of a smart phone 700.

Referring to FIGS. 8 and 9, the electronic device 600 may include a processor 610, a memory device 620, a storage device 630, an input/output (I/O) device 640, a power device 650, and a display device 660. The display device 660 may correspond to the display device 400 of FIG. 6. In addition, the electronic device 600 may further include a plurality of ports for communicating a video card, a sound card, a memory card, a universal serial bus (USB) device, other electronic device, etc. In FIG. 8, the electronic device 600 is implemented as a smart phone 700 but may be a different electronic device in another embodiment.

The processor 610 may perform various computing functions. The processor 610 may be a micro processor, a central processing unit (CPU), etc. The processor 610 may be coupled to other components via an address bus, a control bus, a data bus, etc. Further, the processor 610 may be coupled to an extended bus such as surrounded component interconnect (PCI) bus.

The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 630 may be a solid stage drive (SSD) device, a hard disk drive (HDD) device, a CD-ROM device, etc.

The I/O device 640 may be an input device such as a keyboard, a keypad, a touchpad, a touch-screen, a mouse, etc, and an output device such as a printer, a speaker, etc. In some example embodiments, the display device 660 may be in the I/O device 640.

The power device 650 may provide a power for operations of the electronic device 600.

The display device 660 may communicate with other components via the buses or other communication links. As described above, the display device 660 may include a display panel, a scan driver, a data driver, an emission control driver, and a timing controller. The display panel may include a plurality of pixels. The scan driver may provide scan signals to the pixels. The data driver may provide data signals to the pixels. The emission control driver may provide emission control signals to the pixels.

The emission control driver may include a plurality of stages. Each stage may include a first circuit block, a second circuit block, and a third circuit block. The first circuit block may generate a first control signal and the second control signal based on the start signal or the carry signal. The second circuit block may control a voltage level of the first control signal based on the first control signal and the second clock signal. The third circuit block may generate a third control signal based on the second control signal and the second clock signal.

A first output transistor and a second output transistor may output the emission control signal based on the first control signal and the third control signal. A voltage level of the first control signal may be controlled by the coupling phenomenon using a capacitor when the first output transistor turns off. The voltage level of the first control signal may be maintained by the capacitor when the first output transistor turns on. Thus, the first output transistor may be stably driven.

As described above, the electronic device 600 may include the display device 660 having the emission control driver. Each stage may stably generate the emission control signal by including the first circuit block, the second circuit block, and the third circuit block.

At least one embodiment includes an electronic device having a display device. Examples of the electronic device include a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, drivers, processors, generators including signal generators, and other processing features of the embodiments disclosed herein may be implemented in logic or blocks which, for example, may include hardware, software, or both. When implemented at least partially in hardware, the controllers, drivers, processors, generators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, processors, generators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An emission control driver, comprising:

a plurality of stages, each of the stages including:

a first circuit block to generate a first control signal and a second control signal based on a first clock signal and a start signal or a carry signal;

a second circuit block to control a voltage level of the first control signal based on the first control signal and a second clock signal, the second circuit block including:

a first switching transistor to turn on or turn off based on the first control signal, the first switching transistor coupled between a second clock signal providing line and a third node; and a first capacitor coupled between a first node and the third node;

a third circuit block to generate a third control signal based on the second control signal and the second clock signal;

a first output transistor to output a first voltage as an emission control signal based on the first control signal provided to a first output node; and a second output transistor to output a second voltage as the emission control signal based on the third control signal provided to a second output node, wherein the second circuit block is to maintain a voltage level of the first control signal while the first output transistor is turned off.

2. The emission control driver as claimed in claim 1, wherein the first circuit block includes:

a second switching transistor to turn on or turn off based on the first clock signal, the second switching transistor coupled between a first node and a start signal providing line or a carry signal providing line;

a third switching transistor to turn on or turn off based on a voltage of the first node, the third switching transistor coupled between a first clock signal providing line and a second node; and a fourth switching transistor to turn on or turn off based on the first clock signal, the fourth switching transistor coupled between a first voltage providing line and the second node.

3. The emission control driver as claimed in claim 2, wherein:

the voltage of the first node is to be provided to the second circuit block as the first control signal, and a voltage of the second node is to be provided to the third circuit block as the second control signal.

4. The emission control driver as claimed in claim 1, wherein the second circuit block includes a fifth switching transistor coupled between the third node and a second voltage providing line.

5. The emission control driver as claimed in claim 4, wherein the fifth switching transistor is to turn on or turn off based on the second control signal.

6. The emission control driver as claimed in claim 4, wherein the fifth switching transistor is to turn on or turn off based on the third control signal.

7. The emission control driver as claimed in claim 4, wherein the second circuit block includes:

a sixth switching transistor to turn on or turn off based on the second clock signal, the sixth switching transistor coupled between the first node and a fourth node; and a seventh switching transistor to turn on or turn off based on the second control signal, the seventh switching transistor coupled between the fourth node and a second voltage providing line.

8. The emission control driver as claimed in claim 1, wherein the third circuit block includes:

a fifth switching transistor to turn on or turn off based on the second control signal, the fifth switching transistor coupled between a fifth node and a second clock signal providing line;

a second capacitor coupled between a second node and a fifth node;

a sixth switching transistor to turn on or turn off based on the first control signal, the sixth switching transistor coupled between a second voltage providing line and the second output node;

a seventh switching transistor to turn on or turn off based on the first control signal, the seventh switching transistor coupled between a second voltage providing line and the second output node; and a third capacitor coupled between the second voltage providing line and the second output node.

9. The emission control driver as claimed in claim 1, wherein the first clock signal and the second clock signal have a same period.

10. A display device, comprising:

a display panel including a plurality of pixels;

a scan driver to provide scan signals to the pixels;

a data driver to provide data signals to the pixels;

an emission control driver including a plurality of stages to provide emission control signals to the pixels; and a timing controller to generate control signals to control the scan driver, the data driver, and the emission control driver, wherein each of the stages includes:

a first circuit block to generate a first control signal and a second control signal based on a first clock signal and a start signal or a carry signal;

a second circuit block to control a voltage level of the first control signal based on the first control signal and a second clock signal, the second circuit block including:

a first switching transistor to turn on or turn off based on the first control signal, the first switching transistor coupled between a second clock signal providing line and a third node, and a first capacitor coupled between a first node and the third node;

a third circuit block to generate a third control signal based on the second control signal and the second clock signal;

a first output transistor to output a first voltage as an emission control signal based on the first control signal provided to a first output node; and a second output transistor to output a second voltage as the emission control signal based on the third control signal provided to a second output node, wherein the second circuit block is to maintain a voltage level of the first control signal while the first output transistor is turned off.

11. The display device as claimed in claim 10, wherein the first circuit block includes:

a second switching transistor to turn on or turn off based on the first clock signal, the second switching transistor coupled between a first node and a start signal providing line or a carry signal providing line;

a third switching transistor to turn on or turn off based on a voltage of the first node, the third switching transistor coupled between a first clock providing line and a second node; and a fourth switching transistor to turn on or turn off based on the first clock signal, the fourth switching transistor coupled between a first voltage providing line and the second node.

12. The display device as claimed in claim 11, wherein:

the voltage of the first node is to be provided to the second circuit block as a first control signal, and the voltage of the second node is to be provided to the third circuit block as a second control signal.

13. The display device as claimed in claim 10, wherein the second circuit block includes a fifth switching transistor coupled between the third node and a second voltage providing line.

14. The display device as claimed in claim 13, wherein the fifth switching transistor is to turn on or turn off based on the second control signal.

15. The display device as claimed in claim 13, wherein the fifth switching transistor is to turn on or turn off based on the third control signal.

16. The display device as claimed in claim 10, wherein the second circuit block includes:

a sixth switching transistor to turn on or turn off based on the second clock signal, the sixth switching transistor coupled between the first node and a fourth node; and a seventh switching transistor to turn on or turn off based on the second control signal, the seventh switching transistor coupled between the fourth node and a second voltage providing line.

17. The display device as claimed in claim 10, wherein the third circuit block includes:

a fifth switching transistor to turn on or turn off based on the second control signal, the fifth switching transistor coupled between a fifth node and a second clock signal providing line;

a second capacitor coupled between a second node and a fifth node;

a sixth switching transistor to turn on or turn off based on the first control signal, the sixth switching transistor coupled between a second voltage providing line the second output node;

a seventh switching transistor to turn on or turn off based on the first control signal, the seventh switching transistor coupled between a second voltage providing line and the second output node; and a third capacitor coupled between the second voltage providing line and the second output node.

18. The display device as claimed in claim 10, wherein the first clock signal and the second clock signal have a same period.

* * * * *